US006032943A

United States Patent [19]

Yabushita et al.

[11] Patent Number: 6,032,943

[45] Date of Patent: Mar. 7, 2000

[54] ELASTIC ROLLER

[75] Inventors: Shunichi Yabushita, Nishinomiya; Hirotoshi Murakami; Hitoshi Itani, both of Kobe, all of Japan

[73] Assignee: Sumitomo Rubber Industries, Ltd., Hyogo-ken, Japan

[21] Appl. No.: 08/236,164

[22] Filed: May 2, 1994

Related U.S. Application Data

[63] Continuation of application No. 07/942,886, Sep. 10, 1992, abandoned.

[30] Foreign Application Priority Data

Sep. 21, 1991 [JP] Japan ..... 3-242172

[51] Int. Cl.[7] ..... B65H 5/06; C08K 5/01

[52] U.S. Cl. ..... 271/109; 428/98; 524/484; 524/486; 524/490; 524/491; 524/425; 524/445; 271/314

[58] Field of Search ..... 524/484, 486, 524/490, 491, 425, 445; 271/109, 119, 121, 314; 428/98

[56] References Cited

U.S. PATENT DOCUMENTS

| | | | |
|---|---|---|---|
| 4,111,897 | 9/1978 | Black | 524/579 |
| 4,645,791 | 2/1987 | Theodore et al. | 524/490 |
| 4,853,428 | 8/1989 | Theodore et al. | 524/491 |
| 4,861,819 | 8/1989 | Theodore et al. | 524/491 |

FOREIGN PATENT DOCUMENTS

| | | |
|---|---|---|
| 59-58218 | 4/1984 | Japan . |
| 62-257947 | 11/1987 | Japan . |
| 02070636 | 3/1990 | Japan . |
| 2-70636 | 3/1990 | Japan . |
| 2070636 | 3/1990 | Japan . |
| 4-29538 | 3/1992 | Japan . |
| 7-14770 | 2/1995 | Japan . |
| 979394 | 1/1965 | United Kingdom . |
| 2 078 688 | 1/1982 | United Kingdom . |

OTHER PUBLICATIONS

Papers relating to Opposition against European Patent Application No. 92307951.1 (12).

Itoh et al. "Problem in the design of paper feed rolls"; International Polymer Science and Technology, vol. 14, No. 2, 1987 pp. 42–53.

"Journal of The Society Of Rubber Industry, Japan" vol. 43, No. 2/1970.

"Journal of The Society Of Rubber Industry, Japan" 1985 pp. 495–505; 552.

*Primary Examiner*—Vasu Jagannathan
*Assistant Examiner*—John J. Guarriello
*Attorney, Agent, or Firm*—Nikaido Marmelstein Murray & Oram, LLP

[57] ABSTRACT

An elastic roller contains EPDM rubber as a main component and has a friction coefficient of not less than 2 with respect to ordinary paper and a hardness of not more than 35°.

The amount of softening agent added to EPDM rubber which is a main component is not more than 150 parts by weight per 100 parts by weight of rubber.

8 Claims, 13 Drawing Sheets

FIG.1

| | NATURAL (NR) | STYRENE-BUTADIENE (SBR) | BUTADIENE (BR) | CHLOROPRENE (CR) | ACRYLONITRILE-BUTADIENE (NBR) | ETHYLENE PROPYLENE (EPDM) | URETHANE (U) | SILICONE (MQ) | FLUORINE (FKM) | PHLOROSILICONE (FVMQ) | NORSOREX |
|---|---|---|---|---|---|---|---|---|---|---|---|
| LOW HARDNESS | 40° | 50° | 40° | 50° | 45° | 35° | 60° (20°) | 35° | 60° | 50° | 20° |
| ABRASION RESISTANCE | GOOD | GOOD | GOOD | GOOD | BAD | BAD | GOOD | VERY BAD | BAD | VERY BAD | VERY GOOD |
| OZONE RESISTANCE | VERY BAD | VERY BAD | VERY BAD | VERY GOOD | BAD | VERY GOOD | VERY GOOD | VERY GOOD | VERY GOOD | VERY GOOD | VERY BAD |
| WEATHER RESISTANCE | VERY BAD | VERY BAD | VERY BAD | VERY GOOD | VERY BAD | VERY GOOD | VERY GOOD | VERY GOOD | VERY GOOD | VERY GOOD | VERY BAD |
| HEAT RESISTANCE | GOOD | GOOD | GOOD | GOOD | BAD | GOOD | BAD | VERY GOOD | GOOD | VERY GOOD | VERY BAD |
| COLD RESISTANCE | GOOD | GOOD | VERY GOOD | BAD | BAD | GOOD | BAD | VERY GOOD | VERY GOOD | VERY GOOD | BAD |
| POSSIBILITY OF USE AS PAPER FEED ROLLER | ○ | ○ | ○ | X | X | ○ | ○ | ○ | X | ○ | ◎ |

FIG.2

| | A | B | C | D | E | F |
|---|---|---|---|---|---|---|
| EPDM | 100 | 100 | 100 | 100 | 100 | 100 |
| AMOUNT OF OIL EXTENSION | – | – | – | – | 100 | 100 |
| $ML_{1+4}$@100°C | 43 | 62 | 73 | 85 | 52 | 55 |
| CARBON BLACK | 5 | 5 | 5 | 5 | 5 | 5 |
| SOFTENING AGENT | 100 | 100 | 100 | 100 | – | – |
| FILLER | 50 | 50 | 50 | 50 | 50 | 50 |
| SULFUR | 1 | 1 | 1 | 1 | 1 | 1 |
| ACCELERATOR | 3 | 3 | 3 | 3 | 3 | 3 |
| AKRON ABRASION (cc/1000R) | 0.30 | 0.26 | 0.15 | 0.15 | 0.10 | 0.10 |

FIG.3

| | A | B | C | D | E | F | G | H |
|---|---|---|---|---|---|---|---|---|
| EPDM | 100 | 100 | 100 | 100 | 100 | 100 | 100 | 100 |
| AMOUNT OF OIL EXTENSION | — | — | — | — | — | 100 | 100 | 100 |
| CARBON BLACK | 5 | 5 | 5 | 5 | 5 | 5 | 5 | 5 |
| SOFTENING AGENT | 25 | 25 | 25 | 25 | 140 | 25 | 25 | 25 |
| FILLER | 55 | 30 | 25 | 20 | 50 | 70 | 50 | 20 |
| SULFUR | 1 | 1 | 1 | 1 | 1 | 1 | 1 | 1 |
| ACCELERATOR | 3 | 3 | 3 | 3 | 3 | 3 | 3 | 3 |
| H s (JIS A) | 62 | 45 | 40 | 35 | 25 | 40 | 35 | 25 |
| AKRON ABRASION (cc/1000R) | 0.60 | 0.20 | 0.18 | 0.15 | 0.10 | 0.19 | 0.15 | 0.10 |

FIG.8

| | A | B | C | D | E | F |
|---|---|---|---|---|---|---|
| EPDM | 100 | 100 | 100 | 100 | 100 | 100 |
| CARBON BLACK | 5 | 5 | 5 | 5 | 5 | 5 |
| SOFTENING AGENT | 130 | 140 | 150 | 160 | 180 | 200 |
| FILLER | 50 | 50 | 50 | 50 | 50 | 50 |
| SULFUR | 1 | 1 | 1 | 1 | 1 | 1 |
| ACCELERATOR | 3 | 3 | 3 | 3 | 3 | 3 |
| PROCESSABILITY | ○ | ○ | ○ | △ | × | × |
| STICKINESS OF PRODUCT | NO | NO | NO | SOME | YES | YES |

FIG.9

| | A | B | C | D | E | F | G |
|---|---|---|---|---|---|---|---|
| EPDM | 100 | 100 | 100 | 100 | 100 | 200 | 200 |
| CARBON BLACK | 1 | 5 | 10 | 15 | 20 | 1 | 5 |
| SOFTENING AGENT | 35 | 35 | 35 | 35 | 35 | 35 | 80 |
| FILLER | 25 | 25 | 25 | 25 | 25 | 50 | 50 |
| SULFUR | 1 | 1 | 1 | 1 | 1 | 1 | 1 |
| ACCELERATOR | 3 | 3 | 3 | 3 | 3 | 3 | 3 |
| PAPER CONTAMINATION | 1 | 1 | 2 | 4 | 5 | 0 | 1 |

No 0 ← PAPER CONTAMINATION → 5 CONSIDERABLE

FIG.10

| | A | B | C | D | E |
|---|---|---|---|---|---|
| EPDM | 100 | 100 | 100 | 100 | 100 |
| CARBON BLACK | 5 | 5 | 5 | 5 | 5 |
| SOFTENING AGENT | 140 | 140 | 140 | 140 | 140 |
| FILLER | 60 | 55 | 50 | 45 | 40 |
| SULFUR | 1 | 1 | 1 | 1 | 1 |
| ACCELERATOR | 3 | 3 | 3 | 3 | 3 |
| AKRON ABRASION (cc/1000R) | 0.20 | 0.14 | 0.10 | 0.10 | 0.08 |

ELASTIC ROLLER

This application is a continuation of application Ser. No. 07/942,886 filed Sep. 10, 1992, now abandoned.

BACKGROUND OF THE INVENTION

The present invention relates to an elastic roller, and more particularly it relates to an elastic roller used in the paper feed mechanism of an OA (office automation) business machine, such as a laser beam printer, copying machine, facsimile device or ATM.

As for elastic rollers used in the paper feed mechanisms of laser beam printers, copying machines, facsimile devices, and ATMs, since abrasion resistance is required, rubbers having a high mechanical strength, such as natural rubber, urethane rubber, chloroprene rubber, and Norsorex rubber are in general use.

As for the aforesaid elastic rollers, besides abrasion resistance, which is one of the characteristics required in paper feed operation, the following may be mentioned.

First, it is required that when the elastic roller slips relative to paper, it should not contaminate the paper.

Secondly, when the elastic roller is subjected to a low temperature condition, curing or crystallization should not take place on it.

Thirdly, it is required that the elastic roller should have a high friction coefficient so that it does not slip relative to the paper.

Fourth, since an electronic photograph device, such as a copying machine, has a corona charge therein to effect charging for image transfer, ozone of high concentration is produced in the device. Therefore, it is required that the elastic roller should have ozone resistance so as not to be attacked by ozone.

Fifthly, in recent years, reduction in the size of said OA business machines has advanced and, unlike the case of large-sized machines, periodical maintenance, and exchange of elastic rollers are becoming less frequent. Therefore, it is also required that they should have durability, free from aging or deterioration.

In the requirements described above, particularly, an elastic roller which is superior in ozone resistance is desired in view of the generation of ozone of high concentration in the interior of an electric photograph machine, such as a copying machine. Chloroprene rubber, urethane rubber and silicone rubber are desired because of their high ozone resistance, but when such factors as low hardness, winterization and price are considered, EPDM rubber is the best.

However, though EPDM rubber has good durability against aging and deterioration, it has low mechanical strength and is inferior in abrasion resistance; therefore, EPDM rubber is low in durability for use in machine parts such as paper feed rollers, and hence it has not been used so frequently. Further, in order to decrease hardness, process oil is used, but EPDM rubber itself has a drawback that it hardly mixes with process oil and its processability is poor.

SUMMARY OF THE INVENTION

Accordingly, to solve the above problem, we have comparatively investigated various compositions having EPDM rubber as a main component, intending to provide an elastic roller having characteristics required of a paper feed roller, such as high friction coefficient, durability and less tendency to contaminate paper.

It has been found that an optimum elastic roller based on the results of experiments we have conducted to achieve said object contains EPDM rubber as a main component, and its friction coefficient relative to paper is not less than 2.0 and its hardness is not more than 35°.

Further, in the present invention, it is desirable that the following requirements be met.

First, the amount of softening agent to be added to EPDM rubber which is a main component should be not more than 150 parts by weight per 100 parts by weight of raw rubber.

Secondly, the raw rubber Mooney viscosity of EPDM rubber which is a main component should be not less than 70 ($ML_{1+4}$ @100° C.) or said Mooney viscosity as obtained when 100 parts by weight of process oil is added per 100 parts by weight of rubber is not less than 50 ($ML_{1+4}$ @100° C.).

Thirdly, the amount of carbon black to be added to EPDM rubber which is a main component should be not more than 10 parts by weight per 100 parts by weight of rubber and the amounts of other additives should be not more than 50 parts by weight.

Fourthly, the 10-point average roughness of the surface should be 10–50 $\mu$m.

In an elastic roller according to the present invention, the aforesaid conditions including compositions with respect to EPDM rubber which is a main component provide improvements, satisfying all characteristics required of a paper feed roller; thus, the invention provides an inexpensive elastic roller having a high friction coefficient and superior durability, less tending to contaminate paper.

BRIEF DESCRIPTION OF THE DRAWINGS

FIG. 1 is table showing the characteristics of various rubbers including EPDM rubber which forms a precondition of the present invention;

FIG. 2 is a table showing the relation between Mooney viscosity and abrasion resistance, found by abrasion tests using various EPDM rubbers;

FIG. 3 is a graph showing test results concerning the hardness of EPDM rubber, showing the relation between hardness and abrasion resistance;

FIG. 8 is a graph showing the relation between the amount of softening agent added to EPDM rubber and processability;

FIG. 9 is a table showing the relation between the amount of carbon black added to EPDM rubber and paper contamination;

FIG. 10 is a table showing the relation between the amount of other filler than carbon black added to EPDM rubber and abrasion resistance;

DESCRIPTION OF THE PREFERRED EMBODIMENTS

Figure 4:
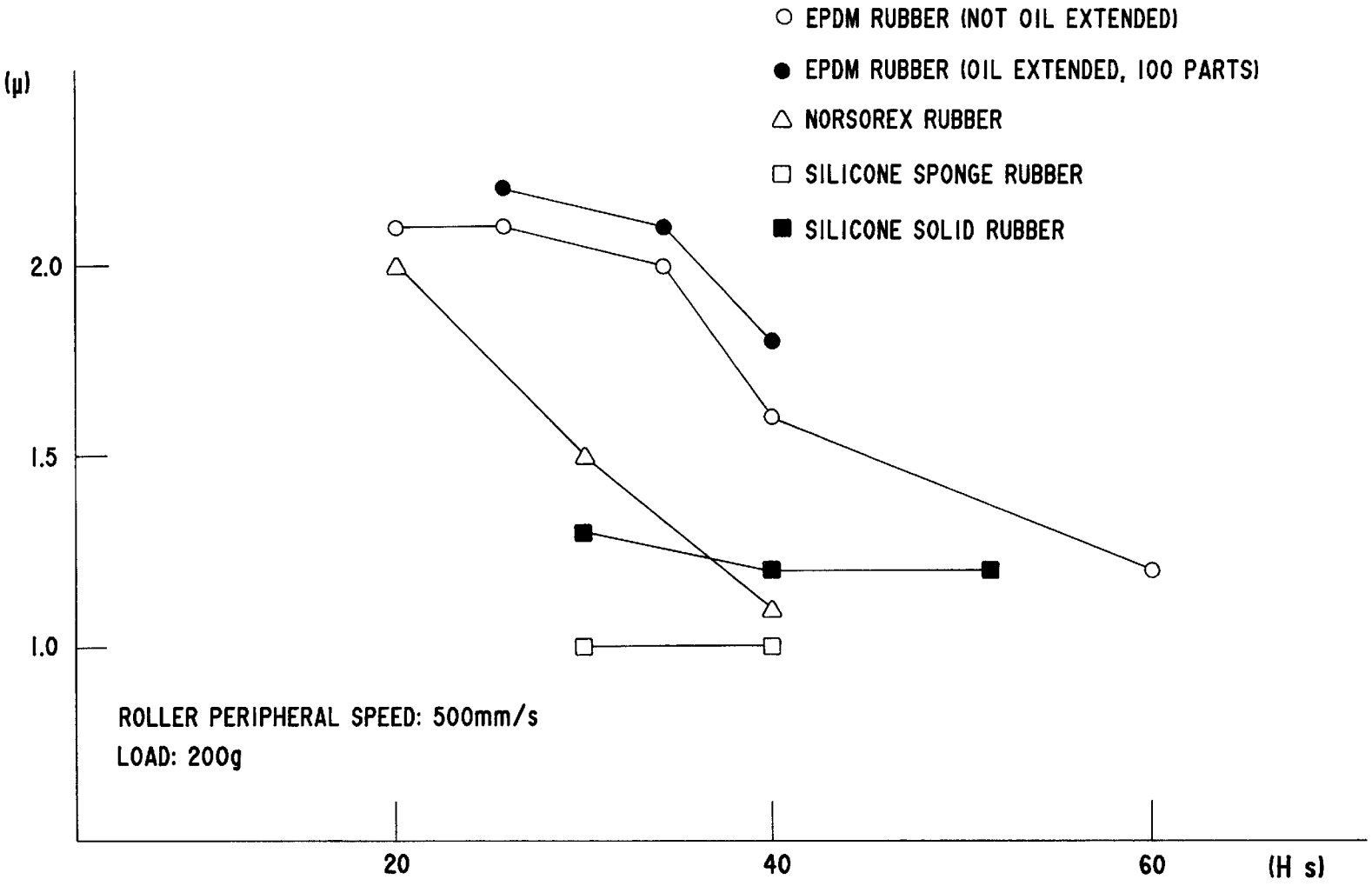
FIG. 4 is a graph showing test results concerning the hardness of EPDM rubber, showing the relation between hardness and friction coefficient.

The results of tests we have conducted on elastic rollers according to the present invention will now be described.

First, EPDM rubber used in the present invention as a precondition is superior in low hardness, ozone resistance, weather resistance, heat resistance and cold resistance but inferior in abrasion resistance which is a mechanical strength. The invention improves the abrasion resistance of this EPDM rubber, thereby providing an optimum article which satisfies all characteristics required of a paper feed roller.

To realize this, we have comparatively investigated various compositions using EPDM as a main component. The results of the tests will now be described in detail.

First, we have conducted abrasion resistance test (BS Standard 903-part A9-C, Akron abrasion tester), the test results being shown in a table in FIG. 2.

In addition, in the embodiments of the present invention to be described below, use is made of Espren 670F (trade name) from Sumitomo Chemical Co., Ltd. as EPDM rubber, FEF as carbon black, Diana Process Oil PW-90 (trade name) from Idemitu Kosan Co., Ltd. as a softening agent, Hakuenka cc (activated calcium carbonate), zinc oxide and stearic acid as fillers, and TRA, TET, Bz and M (trade names) from Outi Sinko Kagaku Co., Ltd. as accelerators.

In the table shown in FIG. 2, EPDM rubbers (A), (B), (C) and (D) have no process oil added thereto, while EPDM rubbers (E) and (F) have 100 parts by weight of process oil added thereto per 100 parts by weight of raw rubber. From the above test results, it is seen that the raw rubber Mooney viscosity of the EPDM (B) is 62 ($ML_{1+4}$ @100° C.) and its Akron abrasion is 0.26 (cc/1000R), which is high, whereas the raw rubber Mooney viscosity of the EPDM (C) is 73 ($ML_{1+4}$ @100° C.) and its Akron abrasion is 0.15 (cc/1000R) which is low, indicating that the abrasion resistance is improved. Thus, for EPDM rubber having no process oil added thereto, it is desirable that its raw rubber Mooney viscosity be not less than 70 ($ML_{1+4}$ @100° C.). On the other hand, the raw rubber Mooney viscosities of the EPDM rubbers (E) and (F) having 100 parts by weight of process oil added thereto are 52 and 55 ($ML_{1+4}$ @100° C.) and their Akron abrasions are both decreased to 0.10 (cc/1000R), indicating that the abrasion resistance is improved. Thus, for EPDM rubber having process oil added thereto, it is desirable that its raw rubber Mooney viscosity be not less that 50 ($ML_{1+4}$ @100° C.).

Further, the results of tests for the hardness of EPDM rubber are shown in FIGS. 3 and 4. As is clear from the table shown in FIG. 3, if the hardness of EPDM rubber is decreased, its abrasion resistance is improved. By decreasing the hardness of EPDM rubber to not more than 35°, as shown in the graph of FIG. 4, friction coefficient ($\mu$=not less than 2.0), a value required for paper feed rollers, is obtained. In addition, as is clear from said graph, if conventional Norsorex rubber, silicone sponge rubber or silicone solid rubber is used, the friction coefficient ($\mu$=not less than 2.0) which is required of paper feed rollers is not obtained. From the table of FIG. 3, it is seen that the hardness of EPDM rubber (D) is 35° and its Akron abrasion is 0.15 (cc/1000R) and the hardness of EPDM (E) is 25° and its Akron abrasion is 0.10 (cc/1000R), indicating that the abrasion resistance is good and, furthermore, from the graph of FIG. 4, it is seen that the friction coefficient ($\mu$=not less than 2.0) which is required of paper feed rollers is obtained; thus, it has been found that EPDM rubbers (D) and (E) are suitable in that they satisfy both requirements. The same may be said of oil extended rubber. In this connection, EPDM rubber (C), though its hardness is 40°, has a relatively low Akron abrasion of 0.18 (cc/1000R), but at said hardness of 40°, the friction coefficient ($\mu$=not less than 2.0) which is required of paper feed rollers is not obtained; thus, it is unsuitable.

Figure 5:
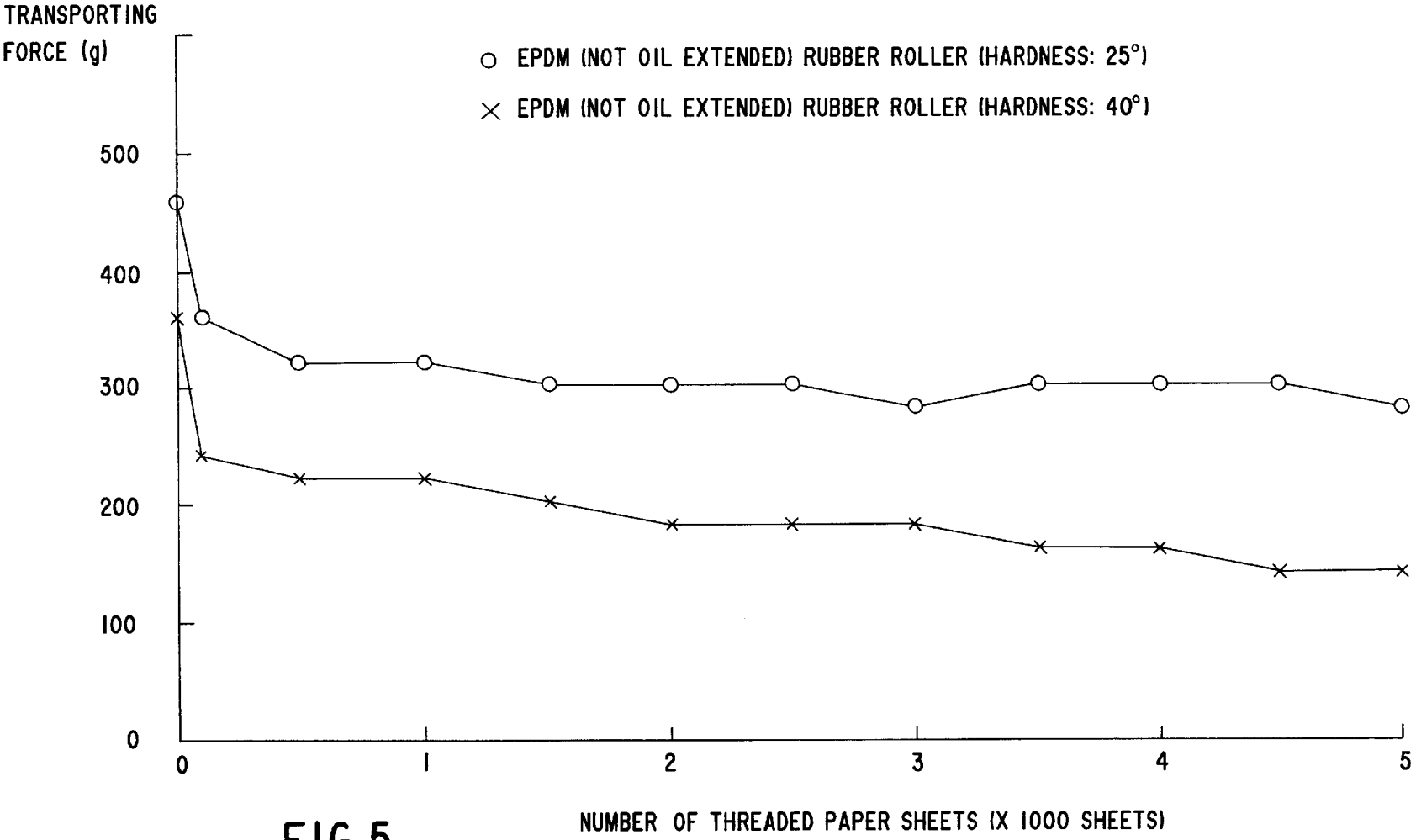
FIGS. 5 and 6 are graphs showing the relation between the number of threaded paper sheets and transporting force concerning EPDM rubbers different in hardness according to the present invention in threaded paper durability tests on EPDM rubber (roller load: 200 g, peripheral speed: 500 mm/s)
Figure 6:
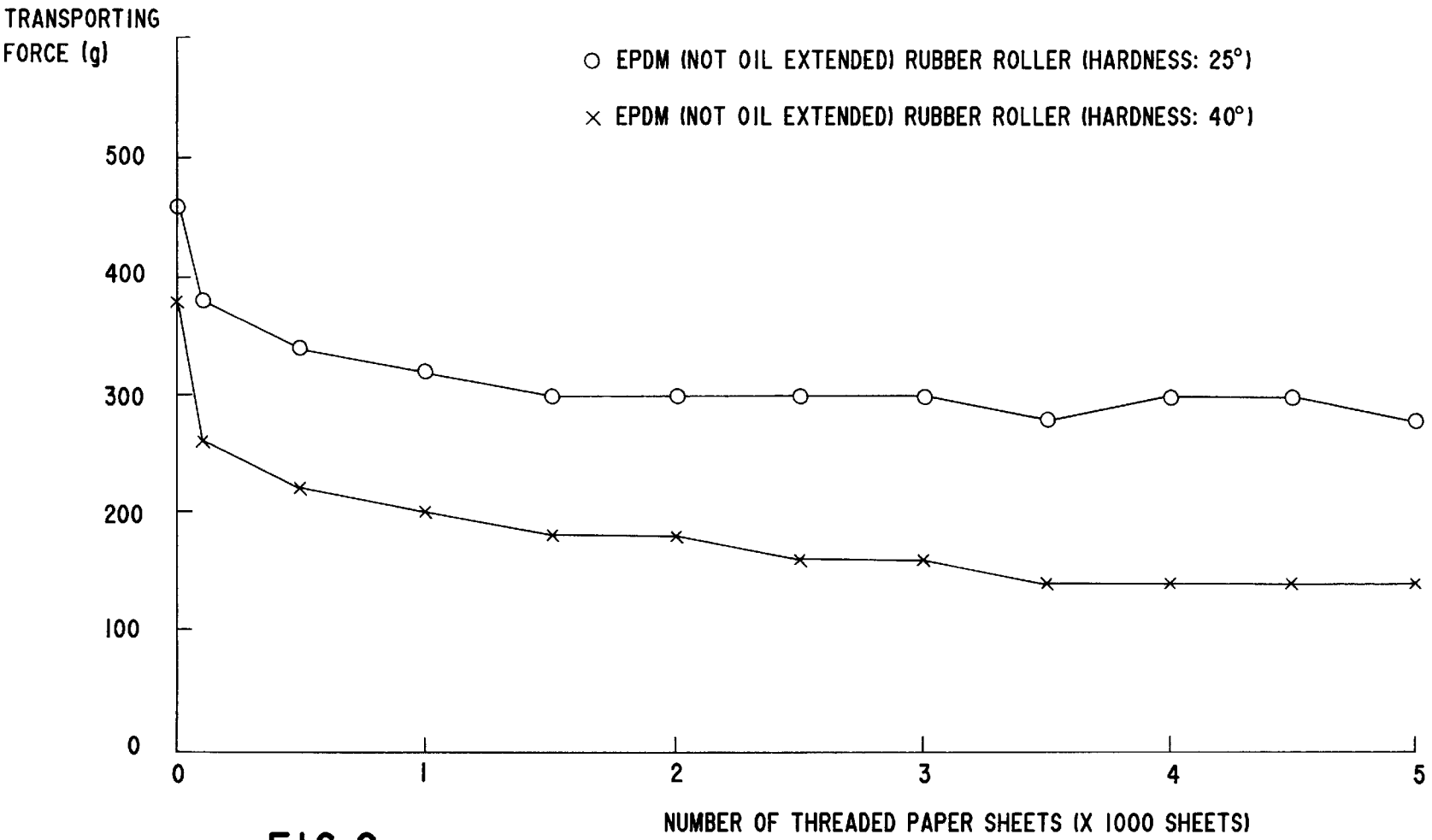
Figure 7:
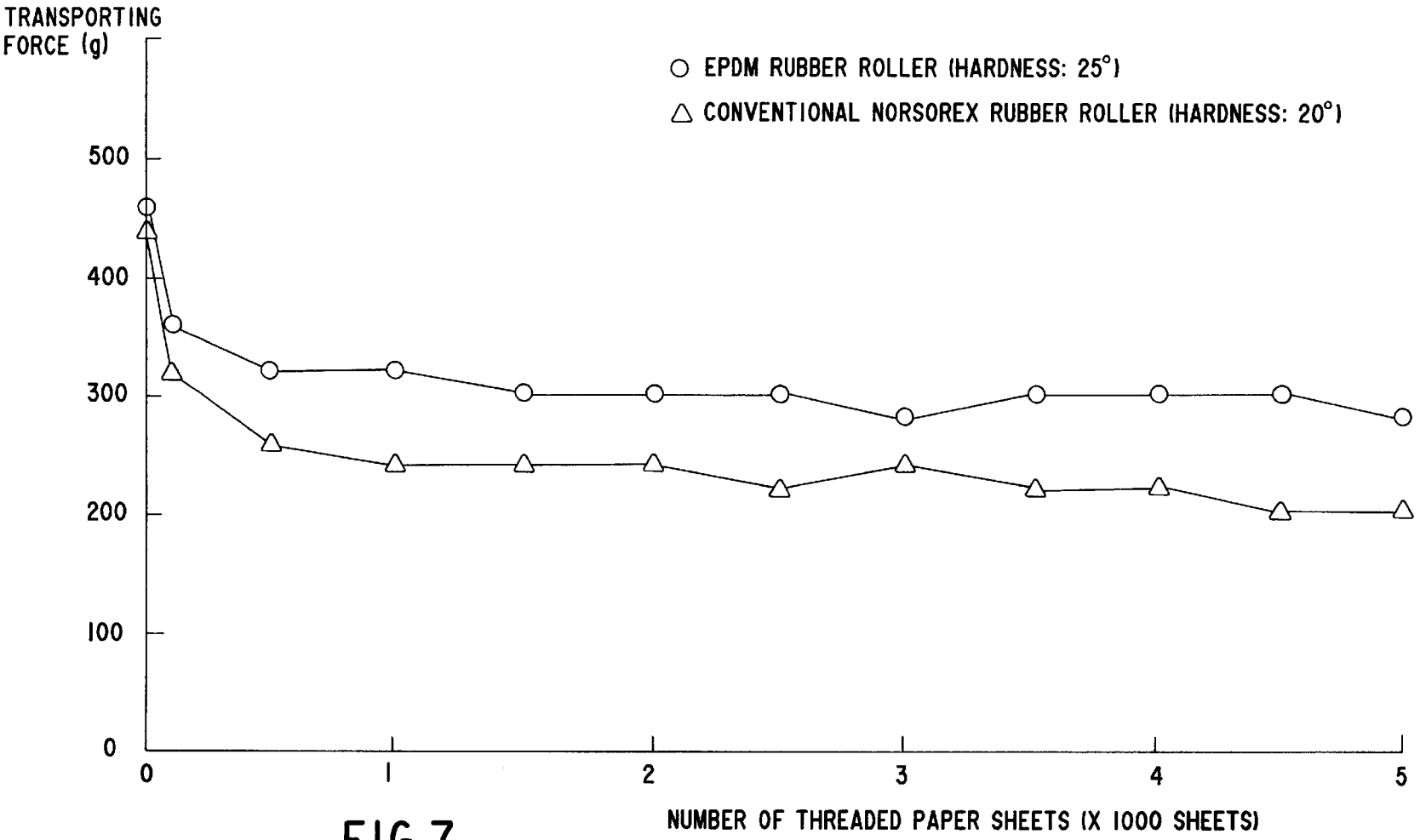
FIG. 7 is a graph showing the relation between the number of threaded paper sheets and transporting force concerning the present inventive article and a conventional article in threaded paper durability tests on EPDM rubber (roller load: 200 g, peripheral speed: 500 mm/s)

Further, we have conducted threaded paper durability tests on said EPDM rubbers (C), (E), (F) and (H). The results are shown in FIGS. 5 and 6, it being clear that EPDM rubbers (C) and (F) having a hardness of 40° greatly decrease in transportability much more than EPDM rubbers (E) and (H) having a hardness of 20° as the number of threaded paper sheets increases, being lower in durability. In addition, we have conducted threaded paper tests on said EPDM rubber in comparison with conventional Norsorex rubber (hardness: 20°). The results are shown in FIG. 7, it being seen that the decrease in transportability as the number of threaded paper sheets increases is less for EPDM rubber (E) than for conventional Norsorex rubber and its durability is better.

As for a softening agent for decreasing the hardness of said EPDM rubbers, use is made of process oil. The results of tests concerning the additive amount of process oil are shown in the table of FIG. 8. From the test results shown in the table of FIG. 8, it is seen that it is preferable that the additive amount of process oil be not more than 150 parts by weight (EPDM (A), (B) and (C)) per 100 parts of the raw rubber for EPDM rubber and that if it is not less than 150 parts by weight (EPDM (D), (E) and (F)), processability is deteriorated, with the surface of a product undesirably becoming sticky. In addition, process oils to be used include the aromatic type, the napthene type and the paraffin type. When paper contamination and photoreceptor contamination are taken into account, the paraffin type is the best. In the embodiment of the present invention, Diana Process Oil PW-90 (trade name) from Idemitu Kosan Co., Ltd. is used; this paraffin oil has its impurities removed by a hydrogenation-based modification process and is very good against paper contamination and photoreceptor contamination.

Further, carbon black is often used as a filler for EPDM rubber. If carbon black is incorporated in forming paper feed rollers, there is the danger of contaminating transfer paper dark. The result of tests conducted to find the relation between the amount of carbon black added to EPDM rubber and paper contamination are shown in the table of FIG. 9. As is clear from this table, it is preferable that the additive amount of carbon black be not more than 10 parts by weight, particularly 5 parts by weight per 100 parts by weight of raw rubber. Thus, in the table of FIG. 9, EPDM rubber (C) whose additive amount of carbon black is 10 is preferable as its degree of paper contamination is about 2, and EPDM rubbers (A) and (B) whose additive amounts of carbon black are 1 and 5, are more preferable as their degrees of paper contamination are both 1. Reversely, if the additive amount of carbon black is not less than 10 parts by weight (EPDMs (D) and (E)), this is not preferable as the paper contamination is high. In addition, carbon blacks to be used, besides FEF used in the embodiment of the present invention, include SAF, HAF and GPF; any of them may be used.

As for other fillers, calcium carbonate, silica and clay are used, the relation between these fillers and abrasion resistance being shown in the table of FIG. 10. As is clear from the test results shown in the table of FIG. 10, the abrasion resistance is deteriorated if said filler is added too much, and in the case of EPDM rubbers (C) and (D), when their additive amounts are 50 and 45 parts by weight per 100 parts by weight of rubber, their Akron abrasions are both 0.10. In the case of EPDM rubber (E), the Akron abrasion is 0.08 when its additive amount is 40 parts by weight per 100 parts by weight of rubber. Each Akron abrasion value is suitable for paper feed rollers. Thus, it has been found that it is preferable that the additive amount of said filler be not more than 50 parts by weight.

Figure 11:
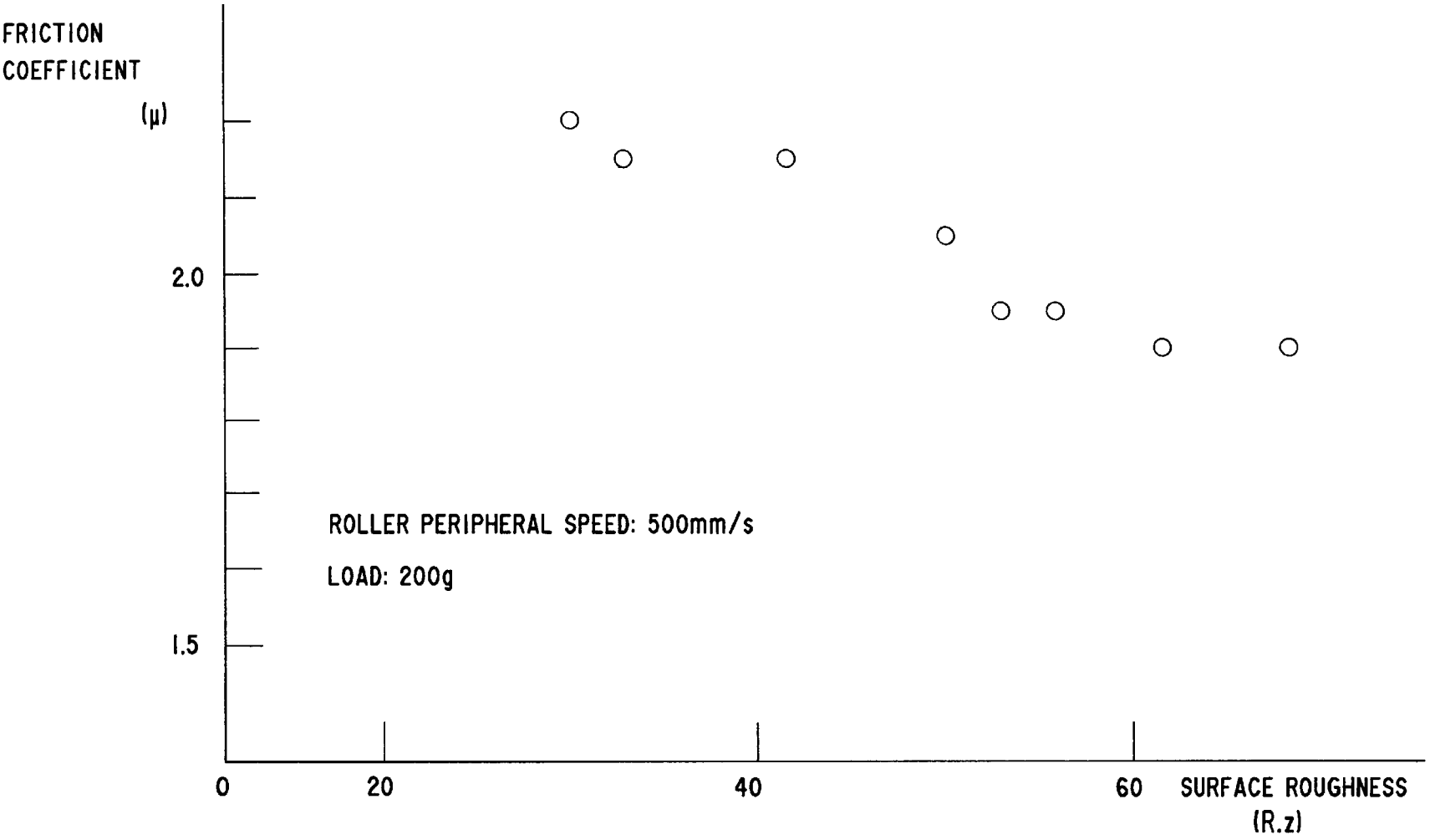
FIG. 11 is a graph showing the relation between roller surface roughness in a roller durability test (200 g×500 mm/s). and friction coefficient.
Figure 12:
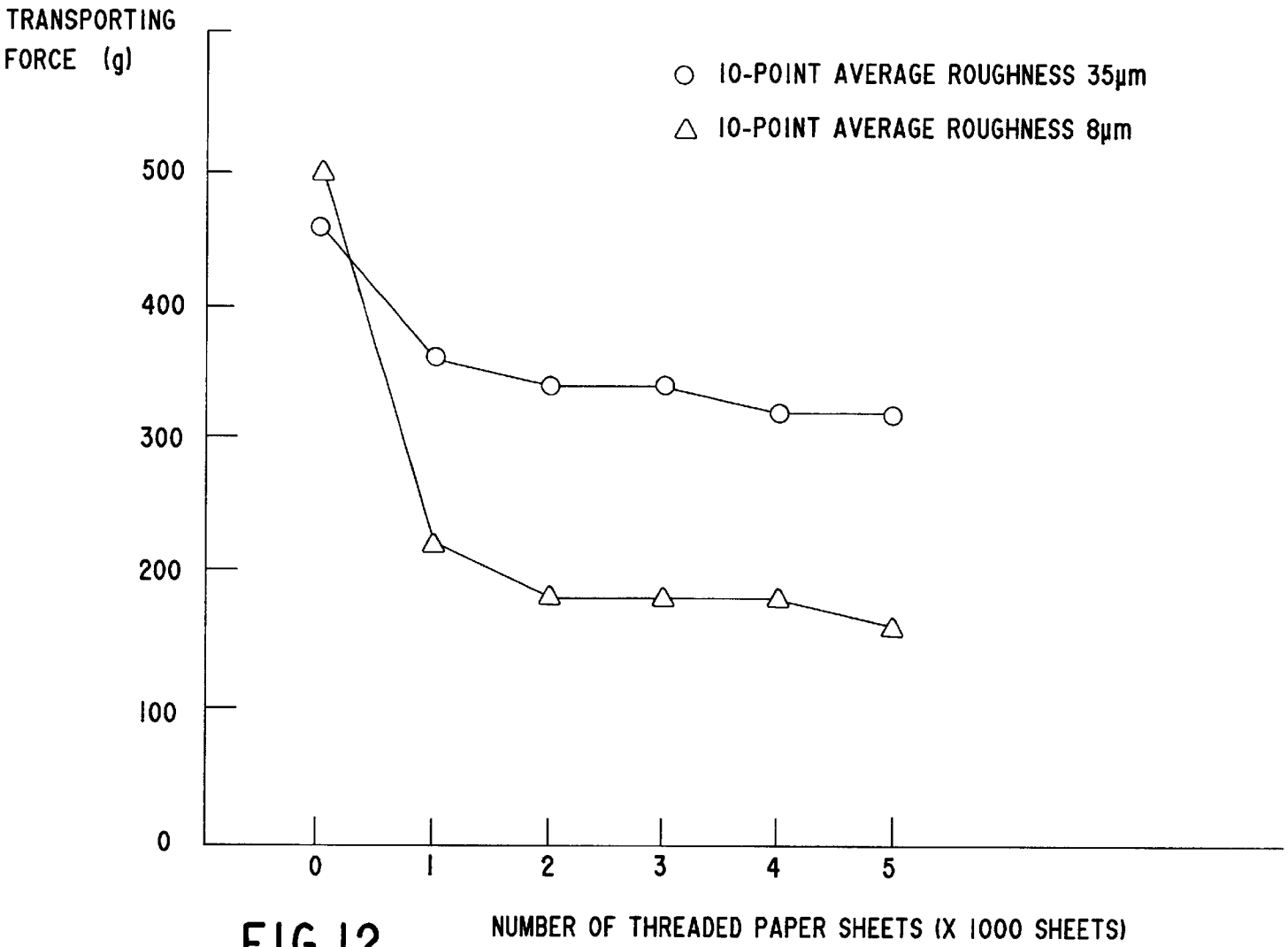
FIG. 12 is a graph showing the relation between the number of threaded paper sheets and transporting force concerning EPDM rubbers different in roller surface roughness.

The relation between roller surface roughness and friction coefficient is shown in FIG. 11 and the relation between roller surface roughness and durability is shown in FIG. 12. In the relation between roller surface roughness and friction coefficient shown in FIG. 11, if 10-point average roughness (JIS B 0601) is not more less than 50$\mu$, then undesirably the friction coefficient ($\mu \geqq 2.0$) for ordinary paper required of paper feed rollers cannot be obtained. Reversely, in the relation between roller surface roughness and durability, if 10-point average roughness is 35$\mu$, the transportability during paper feed does not decrease so greatly as the number of threaded paper sheets increases. However, if the 10-point average roughness is not more than 10$\mu$m, for example, if it is 8$\mu$m, the transportability during paper feed decreases greatly as the number of threaded paper sheets increases, with paper dust tending to adhere to the roller surface and with the durability deteriorating. Thus, it is best that the 10-point surface roughness is in the range of 10–50$\mu$m.

Figure 13:
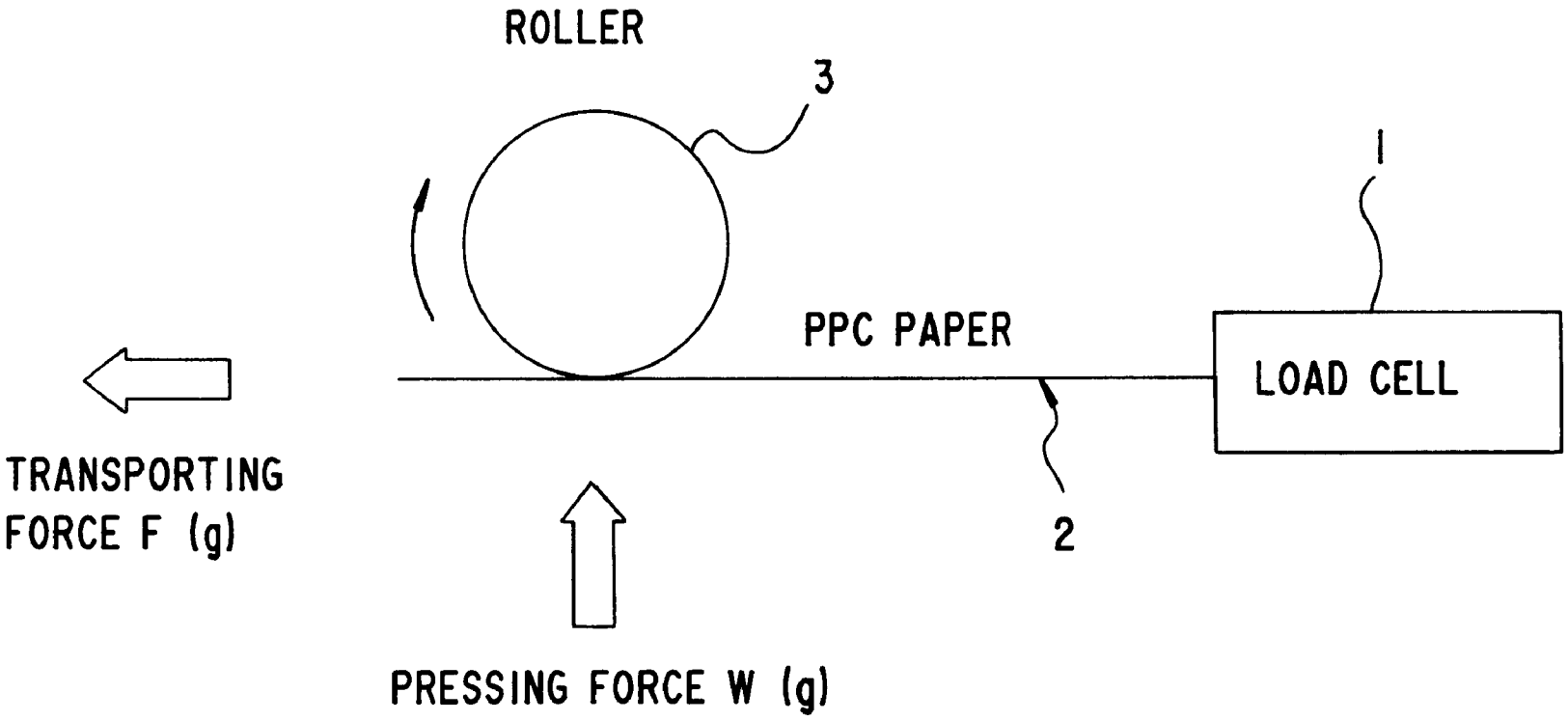
FIG. 13 is a structural view for explaining the measurement of friction coefficient and transporting force described in the specification of the present invention.

In addition, the measurement of friction coefficient and transportability mentioned above was made, as shown in FIG. 13, by pressing PPC paper 2 connected to a load cell 1 against an elastic roller 3 with a pressing force W=200 g, driving said elastic roller 3 at a peripheral speed of 500 mm/s, and measuring the resulting transporting force F g, thereby detecting the friction coefficient $\mu$=F/W.

According to the present invention, the abrasion resistance of an elastic roller using EPDM rubber as a main component is improved by using EPDM rubber of low Mooney viscosity and low carbon filling, with no possibility of transfer paper contamination. Further, even if process oil is sufficiently added, the processability is not impaired while providing a high friction coefficient: thus, an optimum paper feed roller to serve as a paper feeding mechanism can be obtained. The invention is highly practical.

What is claimed is:

1. A rubber elastic roller for paper feeding comprising non-extended EPDM rubber as a main component, said EPDM rubber having a raw rubber Mooney viscosity of not less than 70 and being substantially free of extension oil, said roller further comprising, per 100 parts by weight of said rubber:

softening agent in an amount not more than 150 parts by weight;

filler in an amount not more than 50 parts by weight; and carbon black in an amount not more than 10 parts by weight;

said roller having a hardness not more than 35° and Akron abrasion not more than 0.2 (cc/1000R).

2. A rubber elastic roller for paper feeding as set forth in claim 1, wherein the additive amount of a filler selected from the group consisting of calcium carbonate, silica and clay is not more than 50 parts by weight per 100 parts by weight of raw rubber.

3. A rubber elastic roller for paper feeding as set forth in claim 1, wherein the 10-point surface roughness is in the range of 10–50 $\mu$m.

4. An apparatus for paper feeding comprising elastic rollers as set forth in claim 1.

5. A rubber elastic roller for paper feeding comprising extension oil extended EPDM rubber as a main component, said EPDM rubber having a raw rubber Mooney viscosity of not less than 50, said roller further comprising, per 100 parts by weight of said rubber:

softening agent and extension oil in a total amount not more than 150 parts by weight;

filler in an amount not more than 50 parts by weight; and carbon black in an amount not more than 10 parts by weight;

said roller having a hardness not more than 35° and Akron abrasion not more than 0.2 (cc/1000R).

6. A rubber elastic roller for paper feeding as set forth in claim 5, wherein the additive amount of a filler selected from the group consisting of calcium carbonate, silica and clay is not more than 50 parts by weight per 100 parts by weight of raw rubber.

7. A rubber elastic roller for paper feeding as set forth in claim 5, wherein the 10-point surface roughness is in the range of 10–50 $\mu$m.

8. An apparatus for paper feeding comprising an elastic roller as set forth in claim 5.

* * * * *